US008757516B2

(12) United States Patent
Spiegel et al.

(10) Patent No.: US 8,757,516 B2
(45) Date of Patent: Jun. 24, 2014

(54) COSMETIC AIRBRUSH SYSTEM

(76) Inventors: Peter Spiegel, Sherman Oaks, CA (US); Jonathan Tan, Sherman Oaks, CA (US)

( * ) Notice: Subject to any disclaimer, the term of this patent is extended or adjusted under 35 U.S.C. 154(b) by 337 days.

(21) Appl. No.: 13/238,086

(22) Filed: Sep. 21, 2011

(65) Prior Publication Data

US 2012/0067977 A1 Mar. 22, 2012

Related U.S. Application Data

(60) Provisional application No. 61/384,920, filed on Sep. 21, 2010.

(51) Int. Cl.
*F23D 11/10* (2006.01)

(52) U.S. Cl.
USPC ..... 239/424; 239/423

(58) Field of Classification Search
CPC ..... B05B 1/18; B05B 7/04
USPC ..... 239/423, 424, 433, 570, 302, 329
See application file for complete search history.

(56) References Cited

U.S. PATENT DOCUMENTS

| | | | | |
|---|---|---|---|---|
| 3,993,250 | A | 11/1976 | Shure | |
| 4,030,665 | A | 6/1977 | Koyama | |
| 4,033,511 | A | 7/1977 | Chamberlin | |
| 4,222,525 | A | 9/1980 | Hildebrandt | |
| 5,046,667 | A | 9/1991 | Fuhrig | |
| 5,131,598 | A | 7/1992 | Hoogeveen | |
| 6,560,806 | B1 | 5/2003 | Lawson et al. | |
| 6,595,437 | B1 | 7/2003 | Lawson et al. | |
| 6,892,960 | B2 * | 5/2005 | Ptak et al. | 239/398 |
| 7,032,841 | B1 | 4/2006 | Swisher | |
| 7,036,751 | B1 | 5/2006 | Lund et al. | |
| D534,617 | S | 1/2007 | Federov | |
| 7,191,959 | B2 | 3/2007 | Kutay et al. | |
| 7,350,723 | B2 | 4/2008 | Reedy | |
| 7,448,557 | B2 | 11/2008 | Ray et al. | |
| 2005/0072860 | A1 | 4/2005 | Fedorov | |
| 2007/0215724 | A1 | 9/2007 | Sweeton | |
| 2008/0152580 | A1 * | 6/2008 | Simpson | 423/477 |
| 2009/0206174 | A1 | 8/2009 | Arnaud et al. | |
| 2010/0075019 | A1 | 3/2010 | Scheer | |
| 2010/0170964 | A1 | 7/2010 | Fedorov | |
| 2011/0202019 | A1 * | 8/2011 | Cooper et al. | 604/291 |

* cited by examiner

*Primary Examiner* — Davis Hwu
(74) *Attorney, Agent, or Firm* — Tututnjian & Bitetto, P.C.

(57) ABSTRACT

A self-contained portable liquid cosmetic delivery system for both color makeup and skin care applications is provided. The system includes a spray nozzle assembly having both a liquid path and air path communicates with the housing containing a peristaltic and diaphragm pumping systems. A removable cartridge assembly that allows for very quick changing of cosmetic, while also including a cartridge housing that not only configured to enable the use of a peristaltic pump and diaphragm pump to selectively dispense liquid cosmetic contained in the cartridge housing, it can be manufactured at a reduced cost thus making the same easily cleanable and essentially disposable.

15 Claims, 12 Drawing Sheets

COSMETIC AIRBRUSH SYSTEM

CROSS-REFERENCE TO RELATED APPLICATIONS

This application claims the benefit of and priority from U.S. Provisional Patent Application No. 61/384,920, filed on Sep. 21, 2010.

BACKGROUND

1. Technical Field

The present invention relates to airbrush systems. More particularly, it relates to self contained cosmetic airbrush systems.

2. Description of the Related Art

Various types of airbrush systems are known for painting and applying cosmetics. Generally these systems are designed for professional user by "make-up-artists" and are made up of an air compressor and an airbrush which is attached to the compressor via an air hose. Depending on the action of the airbrush (i.e., single action or double action) the user controls of the dispensing of the paint or cosmetic. Although these systems work, they are bulky and difficult to use, thus not ideal for at home or mobile use by consumers.

Several attempts at providing a handheld solution to this problem have been attempted. These attempts include use of piezoelectric devices and gravity feed systems to create a spray for various applications. Other systems include battery operated devices for use in cleaning operations where the device can draw liquid from a bottle of cleaning solution. However in cleaning operations, the velocity of the spray is irrelevant and therefore these systems cannot be used in more accuracy demanding applications such as painting, and/or more specifically, cosmetic applications.

SUMMARY

As will be appreciated by those of skill in the art, the Cosmetic Airbrush System of the present invention provides the following advantages over other known systems: This is achieved in accordance with an implementation of the invention, wherein the airbrush system includes a housing, a liquid cartridge assembly contained within the housing, a diaphragm pump configured to generate air and in communication with the housing to provide air into a nozzle spraying chamber, and a spray nozzle assembly configured to attach to the nozzle spraying chamber. The spray nozzle assembly includes a liquid path centrally disposed there through, and an air passage way configured annularly around the liquid path such that the liquid and air meet at a tip of a spray nozzle assembly.

In accordance with one implementation, the housing includes a nozzle spraying chamber, a peristaltic pump configured to selectively draw liquid out of the pouch, and a motor providing power to the peristaltic pump.

According to another aspect, the liquid cartridge assembly includes a liquid reservoir pouch, and a flow check valve assembly for preventing liquid contained in the pouch from drying when not in use;

In yet another aspect, the spray nozzle assembly includes a nozzle housing, a spray nozzle having one end configured to be partially inserted into the nozzle housing, and a nozzle housing cap having an outlet tip and being configured to receive the nozzle housing and spray nozzle and securing the spray nozzle assembly to the nozzle spraying chamber. The spray nozzle and nozzle housing cooperate to mix the liquid drawn from the reservoir pouch and through the spray nozzle with the air generated by the diaphragm pump at the tip of the nozzle housing cap.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1B:
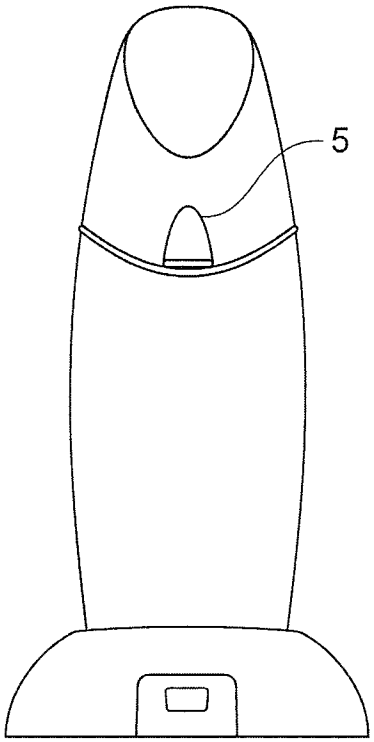
FIG. 1*b* is another perspective view of the airbrush system according to an embodiment of the invention.
Figure 1A:
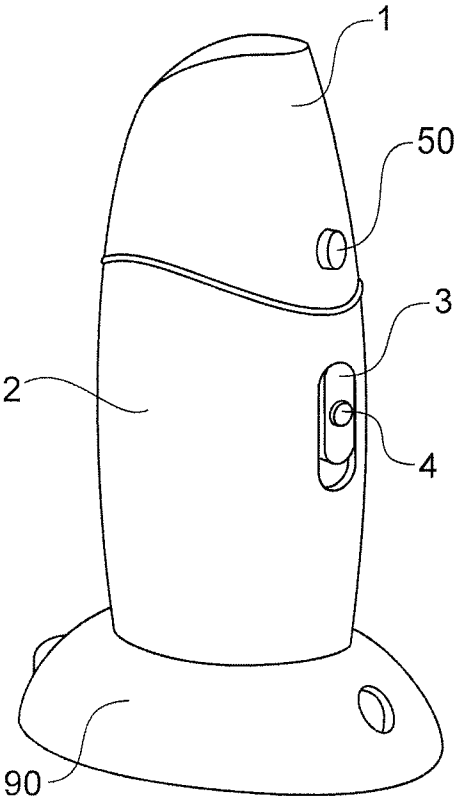
FIG. 1*a* is a perspective view of the airbrush system according to an embodiment of the invention.

The airbrush device of the present invention is built as a self-contained portable liquid cosmetic delivery system for both color makeup and skin care applications. As shown in FIGS. 1*a* and 1*b*, the device is composed of a main body housing 2, a removable liquid cosmetic cartridge assembly 50 (FIGS. 3*a* and 3*b*), an optional battery rechargeable dock 90, and a top cover 1 to be used to protect, conceal or hold the self-contained liquid cosmetic cartridge assembly 50 in place within the housing 2. The top cover 1 can be completely detached from the main body by pressing the cover release button 5, or can be open but remain connected to the main body 2 through at least one hinge.

Figure 1C:
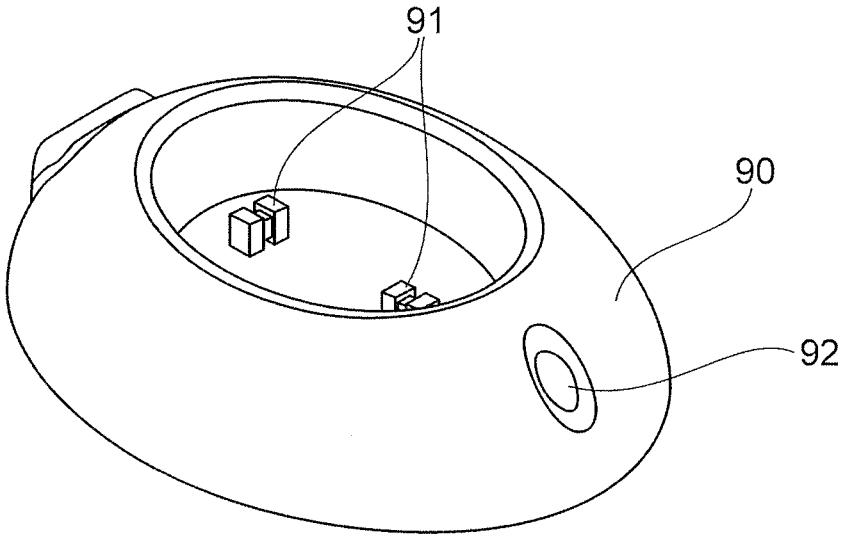
FIG. 1*c* is a perspective view of the base for the airbrush according to an embodiment of the invention.
Figure 1D:
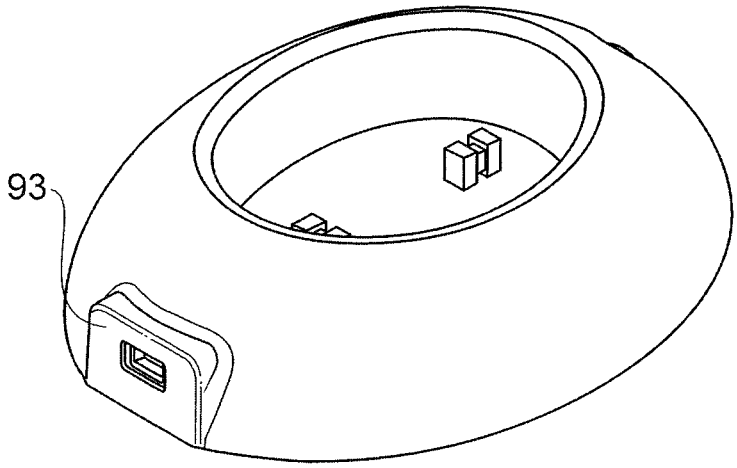
FIG. 1*d* is another perspective view of the base for the airbrush according to an embodiment of the invention.

FIGS. 1*c* and 1*d* show an example of the battery charging dock 90 used to recharge the internal battery within the airbrush, according to an embodiment of the invention. The airbrush device will sit directly inside the base. Power will be transferred to the battery along the two connection pins 91 at the face of the base. It has a dual color LED charging induction indicator 92. During initial activation, a "drain battery" indication is provided by the LED illuminating in a color, including, but not limited to, the color red, blue or green. Along the period of the charging process the initial LED color will slowly turn toward to a different color, including but not limited to red, blue or green, which indicates the battery is fully charged. The battery charging dock 90 can be connected through a mini USB connection outlet 93 which can be either connected to a DC power supply rated 4.5V voltage and 500 mA current, or to a powered USB port (e.g., same as cell phone charger).

Figure 2:
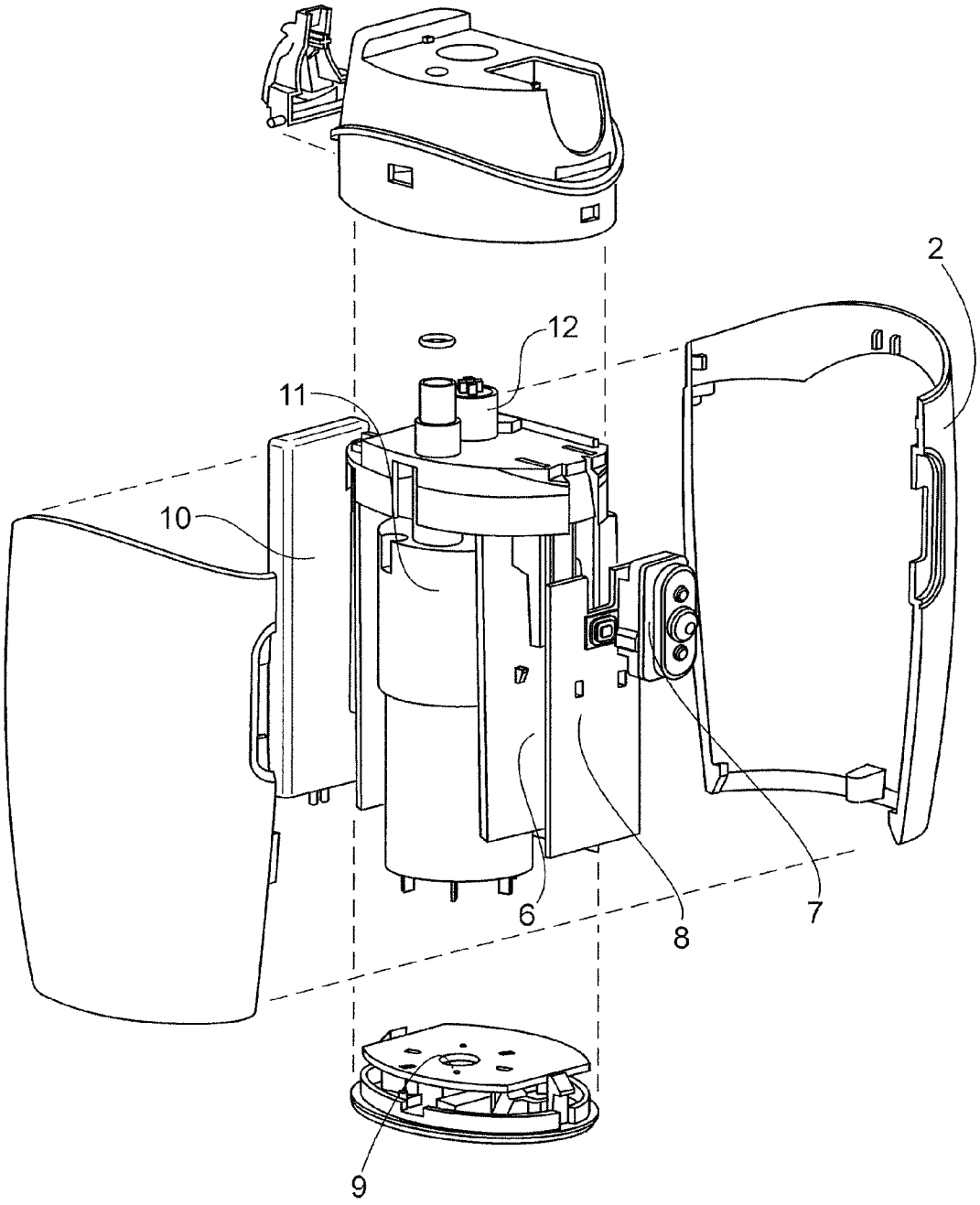
FIG. 2 is an exploded perspective view of the cosmetic airbrush system according to an embodiment of the invention.

Shown in FIG. 2, the main housing 2 contains an internal housing 6 which holds an electric mini DC diaphragm pump 11, an electric mini DC motor 12, a battery power source 10 for activating the electric motor and diaphragm pump, a printed circuit board (PCB) 8 to control the electric components, a battery recharging sub assembly 9, and On/Off switch assembly 7.

Also shown in FIG. 2, the On/Off switch assembly 7 is a two part interacting switch. In order to be able to press in the On/Off button 4 the entire switch must slide upward. Once the switch is in the upward position, the On/Off button 4 can be pressed and held down for the device to be powered on. The device will stay on as long as On/Off button 4 remains depressed. Once the On/Off button 4 is released the device will power off.

Figure 3B:
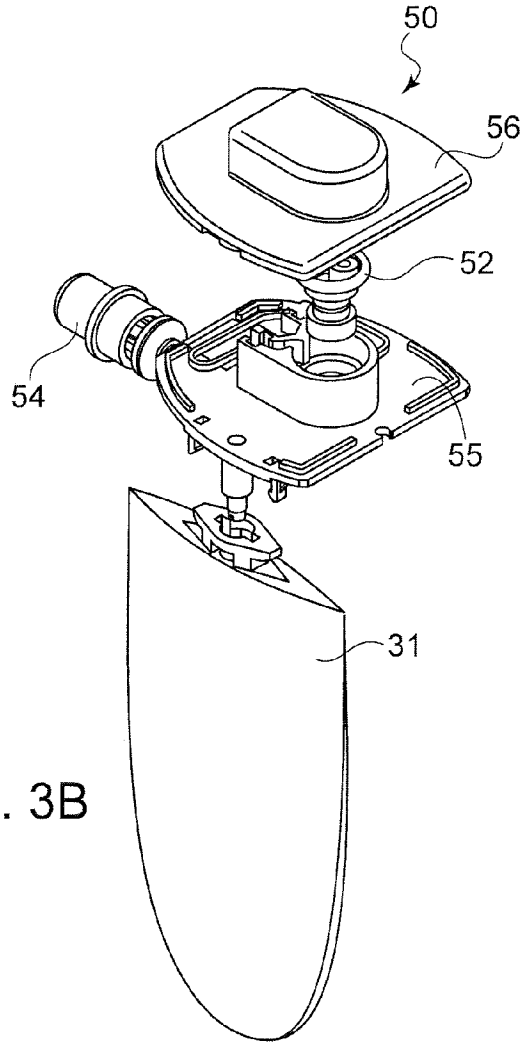
FIG. 3*b* is an exploded perspective view of the liquid cartridge system according to an embodiment of the invention.
Figure 3A:
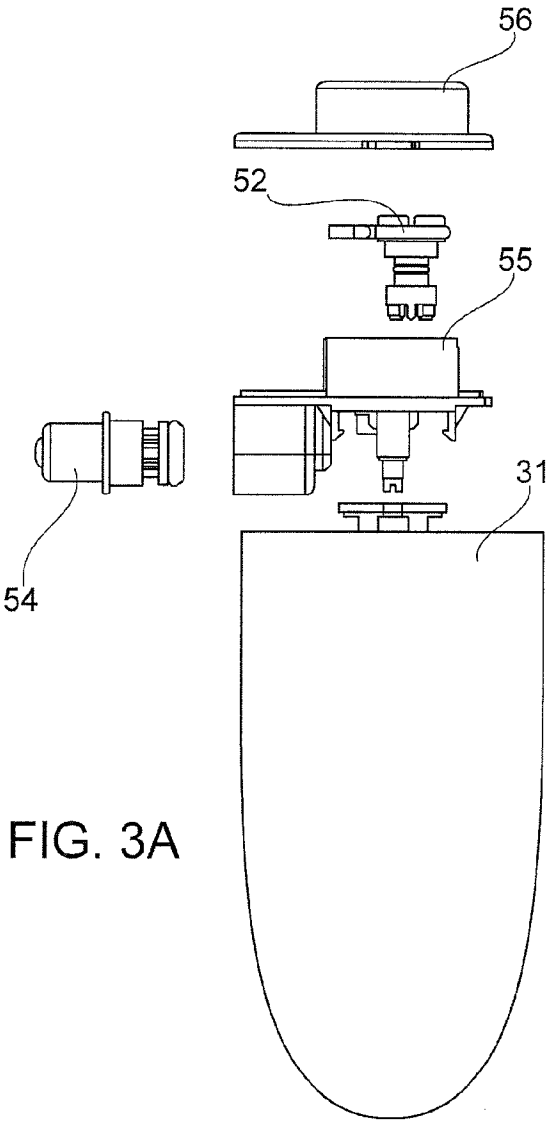
FIG. 3*a* is an exploded front view of the liquid cartridge system according to an embodiment of the invention.

FIGS. 3*a* and 3*b*, show the liquid cosmetic cartridge assembly 50 according to an embodiment of the invention. The cartridge assembly 50 is composed of a liquid cosmetic reservoir pouch assembly 31, a cartridge housing 55, a cartridge housing cap 56 which encloses the cartridge housing to conceal, protect or hold the internal components together. The top cover 1 engages the top of the housing cap 56 to enclose the top of the cartridge assembly 50 when inserted into the housing 2. The cartridge housing 55 also includes a peristaltic pump 52, and a spray nozzle assembly 54 (described in more detail below).

Figure 4:
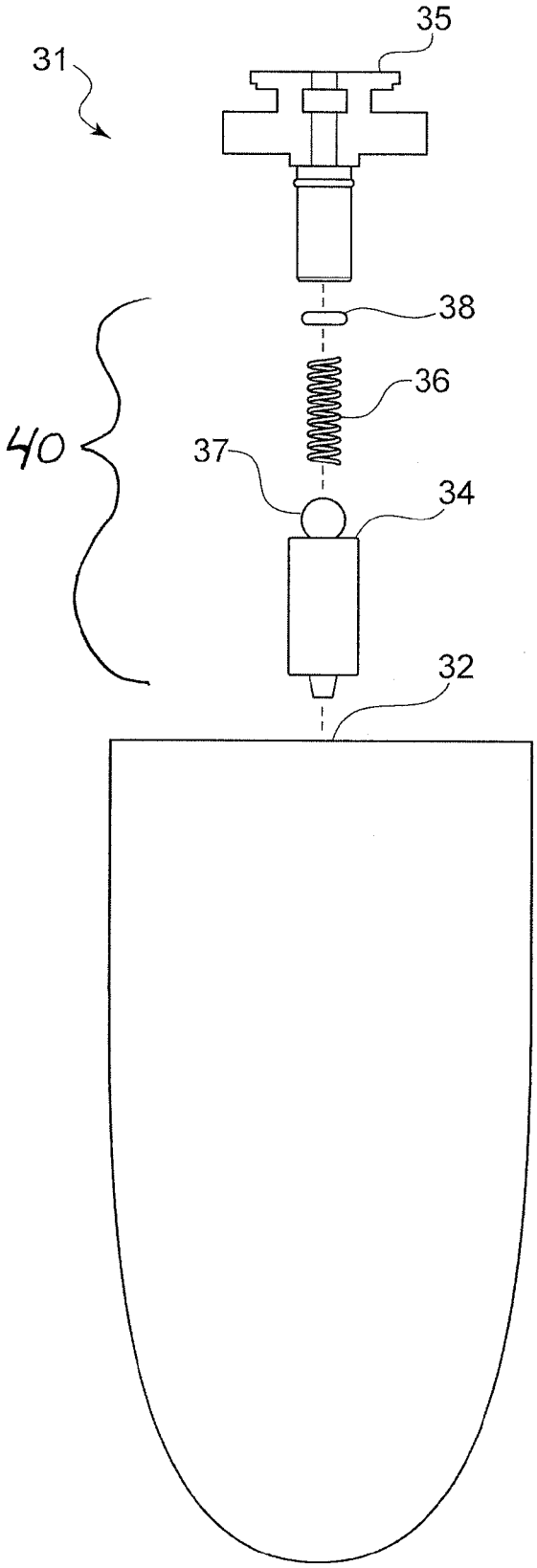
FIG. 4 is an exploded view of the liquid reservoir pouch assembly according to an embodiment of the invention.

FIG. 4 shows the liquid cosmetic reservoir pouch assembly 31 which, according to an embodiment of the invention, includes a soft liquid cosmetic reservoir pouch 32, and is preferably made out of flexible material, such as for example, plastic, aluminum (e.g., foil like bag or pouch), rubber, etc. or any other suitable material having a sufficiently high air/water barrier. The thickness of the material is preferably 1.0 mm, is heat sealed and includes a liquid flow check valve assembly 40 having a valve outer cover 34, an inner surface of housing 35, a spring 36, a ball bearing 37 preferably having a diameter of, for example, 2.8 mm. The valve outer cover 34 holds the internal parts together within the inner surface of housing 35. The spring 36, when relaxed in its natural state will push the ball bearing against the inner surface of housing 35 to form an air-tight seal. This will seal the liquid reservoir pouch 32 and prevent the liquid contained therein from drying up before it is assembled into the liquid cartridge assembly 50. Once the reservoir pouch 32 is assembled into the liquid cartridge assembly 50, the internal spring 36 and the ball bearing 37 will be pushed into contraction, and thereby open the flow check valve 40. Once the check valve is open, it is then liquid cosmetic can be drawn out from the liquid reservoir pouch 32 via the peristaltic pump.

Figure 5:
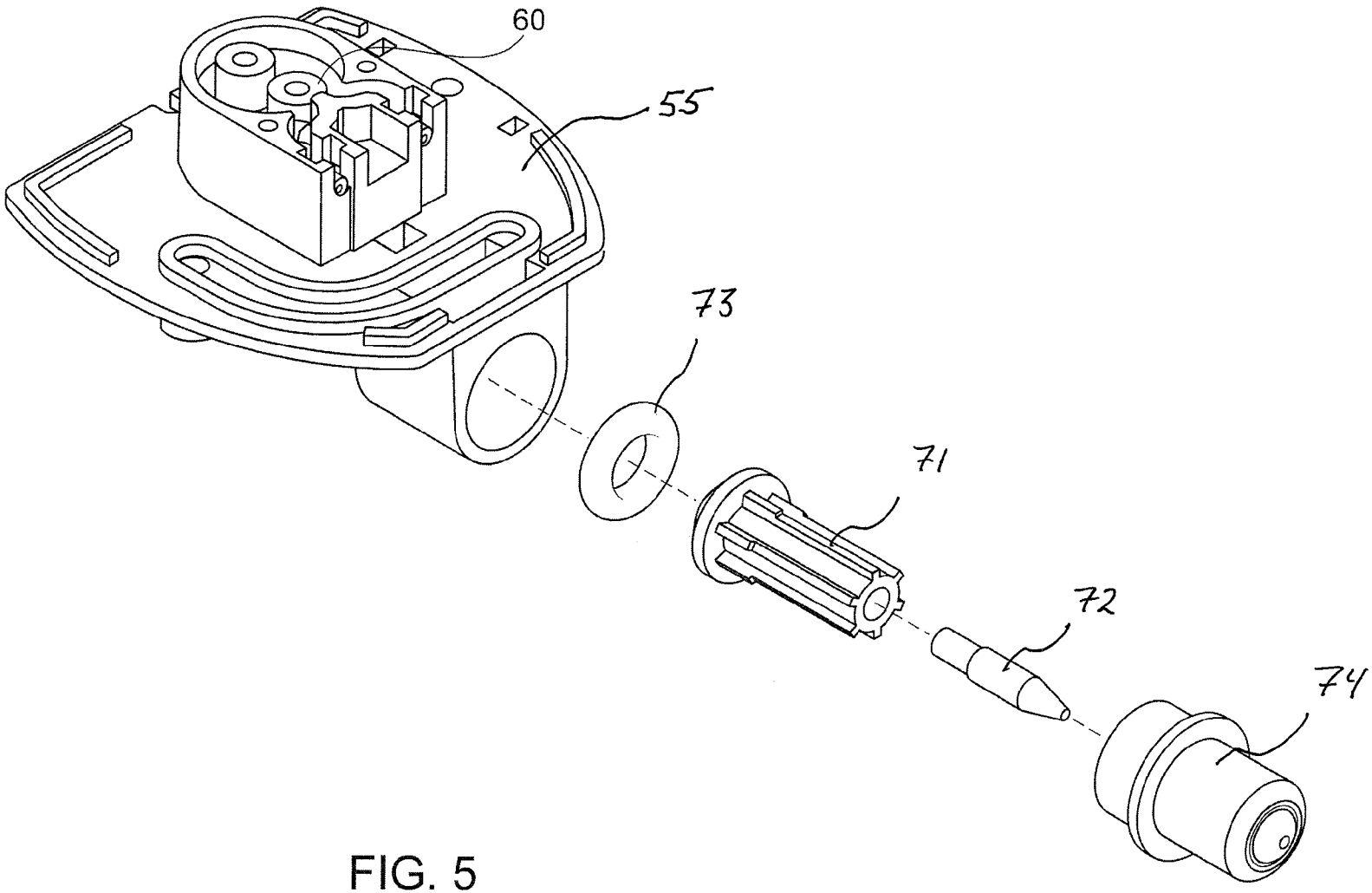
FIG. 5 is a perspective view of the peristaltic pump of the cosmetic airbrush system according to an embodiment of the invention.
Figure 6:
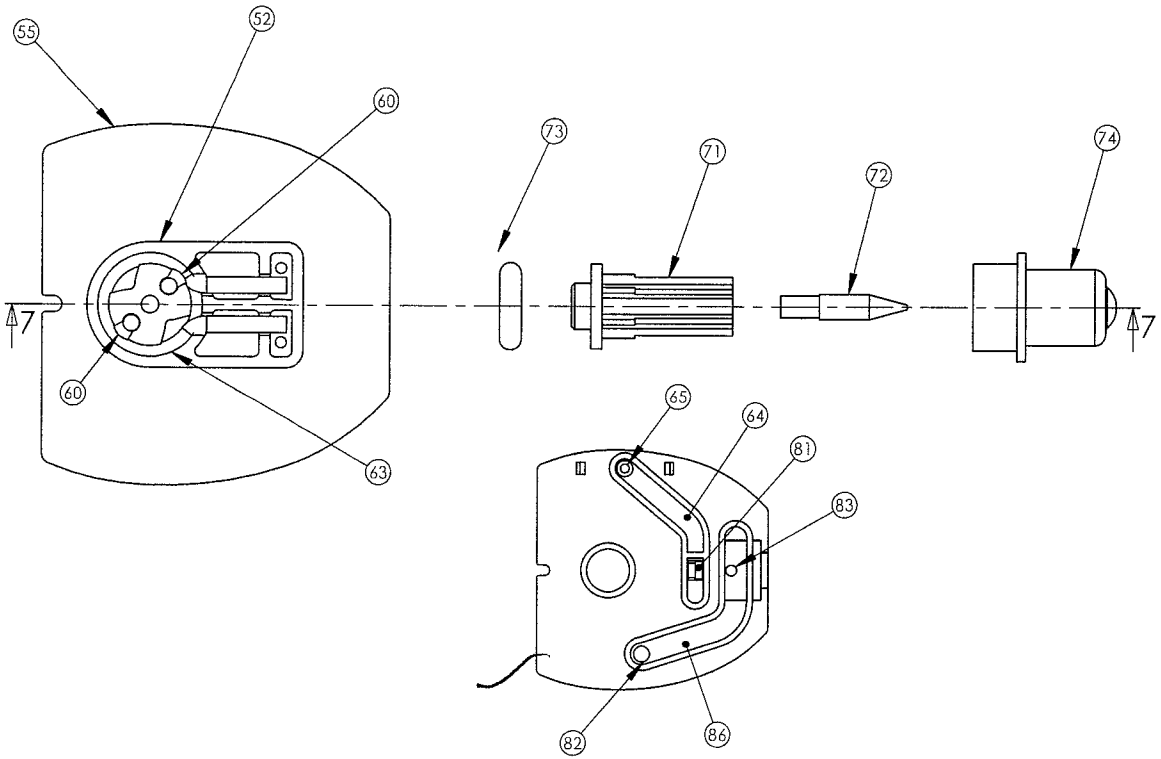
FIG. 6 is a top view of the peristaltic pump of the cosmetic airbrush system according to an embodiment of the invention.

Shown in FIGS. 5-6, the peristaltic pump 52 comprises two rollers 60 having a preferred diameter of 3.5 mm, a pump shaft 61, a set of connector gearing 62 (FIG. 7), a soft flexible fluoroelastomer tube 63 which has a preferred inner diameter of 0.5 mm and outer diameter of 1.5 mm with a total length of 38.2 mm. The peristaltic pump is driven directly by a mini electronic DC motor 12 (FIG. 2) which is supplied with power from batteries or an AC/DC transformer providing the requisite DC voltage/amperage. The DC motor 12 is rated at 3.7V voltage, 80 mA current, and spinning at 20 RPM. The DC motor 12 directly connects to the bottom of the pump shaft via a set of connector gearing 62. The rollers 60 are mounted 180° away from each other at the top end of the pump shaft 61. As rollers 60 rotate along with the pump shaft 61, they will presses the flexible fluoroelastomer tubing 63 against the surrounding wall inside of the cartridge housing 55. This will displace the volume inside and along the tubing creating suction. Once suction is created in the system, it will allow the peristaltic pump to draw the liquid cosmetic out from the liquid reservoir pouch 32. The liquid cosmetic will travel upward into the liquid cosmetic inlet 65 and along the liquid cosmetic flow channel 64, and exit into the nozzle spraying chamber 78.

Figure 8A:
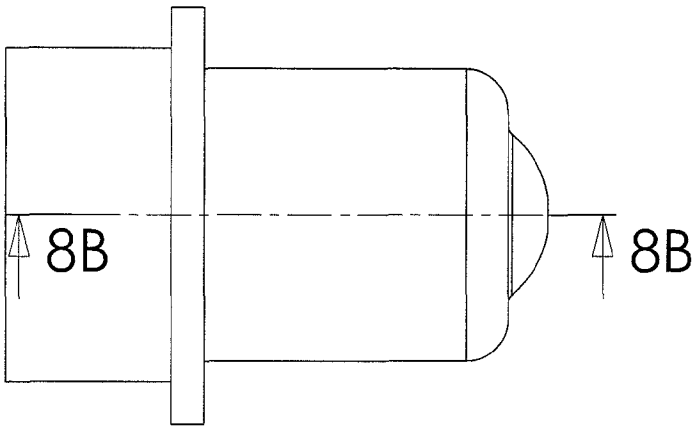
FIG. 8*a* is a side view of the spray nozzle housing according to an embodiment of the invention.
Figure 8B:
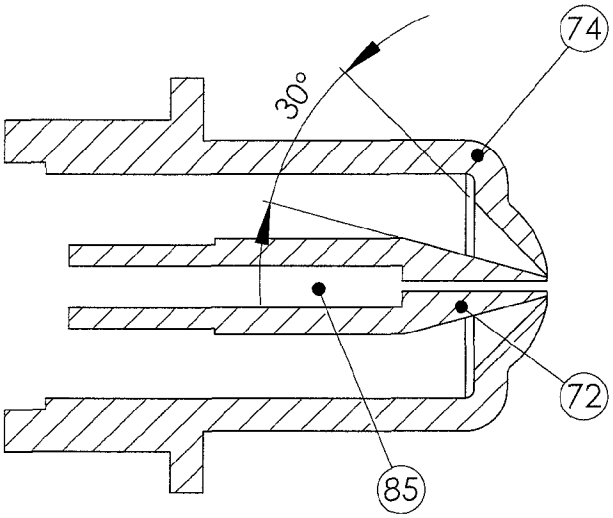
FIG. 8*b* is a cross-sectional view the spray nozzle taken along line A-A of FIG. 8*a*.

FIG. 6 shows the spray nozzle assembly made up of a nozzle housing 71, which houses the a spray nozzle 72, a O-ring 73 to keep the assembly air tight, a nozzle housing cap 74 to encapsulate the assembly together with the cartridge housing 55, and a nozzle cover 75. The spray nozzle 72 can be made out of any suitable materials including, but not limited to, stainless steel, plastic or rubber. Its entrance opening 76 has an inner diameter of 1.5 mm and its exit opening 77 has an inner diameter of 0.19 mm. The exit tip forms a 30° angle to the nozzle housing cap 74 and are spaced apart (See FIGS. 8*a* and 8*b*). The nozzle housing 71 functions to hold the spray nozzle 72 secure and center it within the spraying chamber 78.

Figure 7:
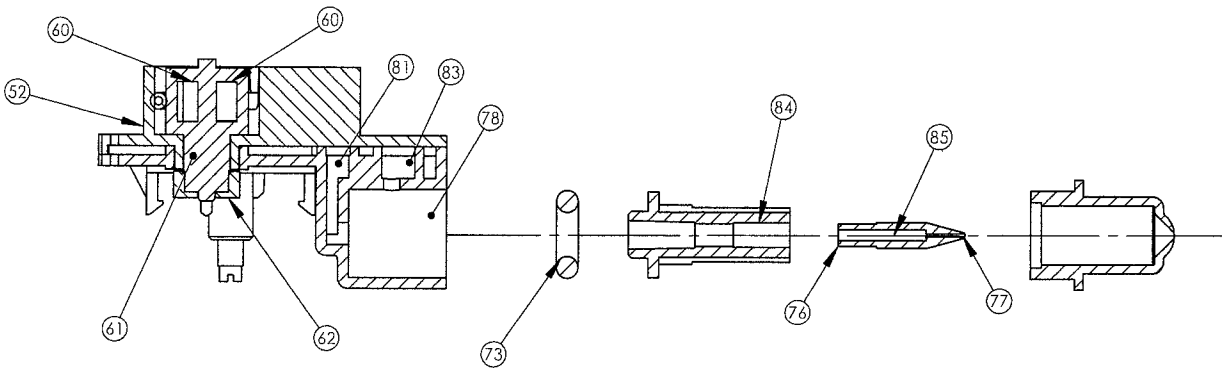
FIG. 7 is a cross-sectional view of the peristaltic pump taken along the line A-A of FIG. 6.

As shown in cross-sectional view of FIG. 7, the airbrush device sprays out liquid cosmetic in two steps. First the liquid cosmetic is pumped out from the liquid cosmetic reservoir pouch 32. The liquid cosmetic will travel along the liquid flow channel 64 (not shown?) and into the flexible fluroelastmor tubing 63. The liquid cosmetic will then continue through the tubing and pump through the liquid nozzle inlet 81 and into the nozzle spraying chamber 78. At the same time pressurized air will be pumped out of the diaphragm pump up into the liquid foundation cartridge 50 and up through air let valve 82.

The air will first enter through air let valve 82, travel along the air channel 86 and into the nozzle air inlet 83 and into the nozzle spraying chamber 78. Inside the nozzle spraying chamber, the air will be traveling at the outer or annular chamber channel 84, while the liquid cosmetic will flow through in the inner chamber channel 85. Both air and the liquid cosmetic will meet together in the outer tip of the spray nozzle 72, at which it will mix and spray out of the nozzle housing cap 74.

Figure 9A:
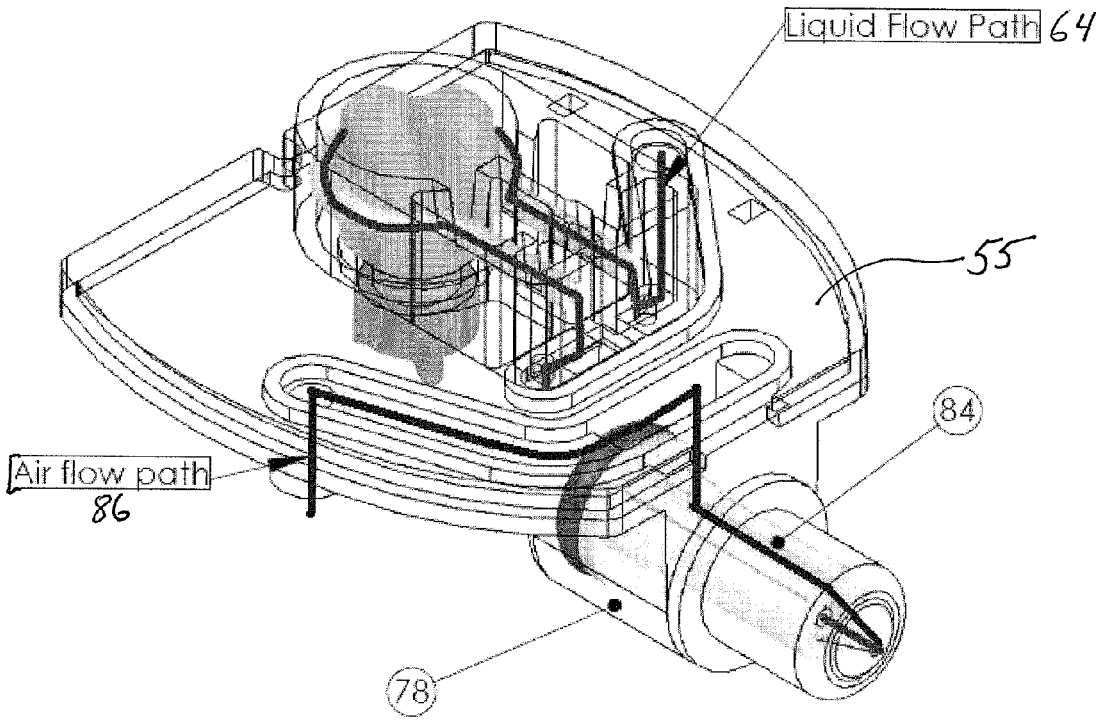
FIGS. 9*a*-9*c* are various views of the cartridge housing according to an embodiment of the invention.
Figure 9B:
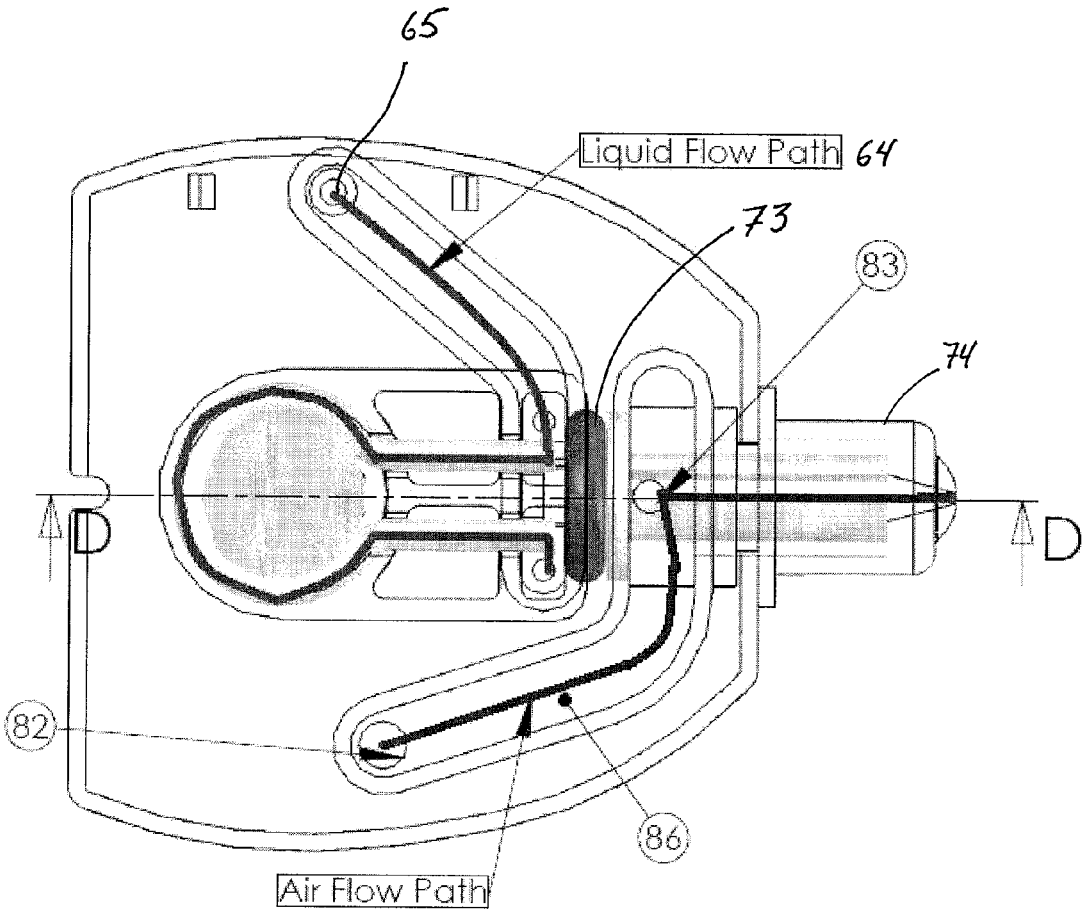
Figure 9C:
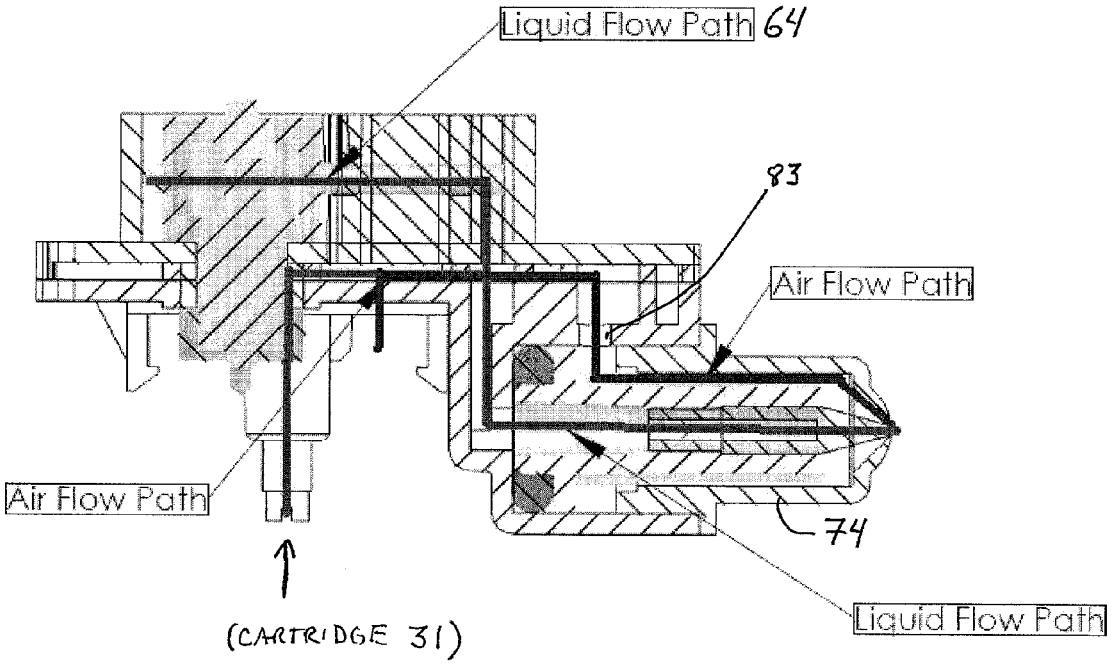

FIGS. 9A-9C show the liquid flow path 64 and air flow path 86 according to according the above described embodiments.

The airbrush device of the present invention is designed to be able to spray liquid cosmetic with a velocity of 10~20 Pa-s and with particle size diameter of 15~25 μm. The nozzle is designed to spray the above liquid cosmetic in a circular 25 mm diameter spraying pattern from 63.5 mm up to 76.2 mm distance away from the nozzle tip.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A hand held self contained airbrush system comprising:
a housing;
a liquid cartridge assembly contained within the housing said liquid cartridge assembly comprises:
a liquid reservoir pouch and
a flow check valve assembly for preventing liquid contained in the pouch from drying when not in use, wherein the flow check valve assembly further comprises:
a valve outer cover having one end in permanent connection with the liquid reservoir pouch and an upper end;
a ball bearing positioned in contact with the upper end of the valve outer cover;
a spring 36 having one end in contact with the ball bearing and an opposing end; and
an inner surface housing retaining said ball bearing and spring in positioned against said valve outer cover;
said spring and said ball bearing cooperating to provide an air-tight seal to the reservoir pouch when not connected to the housing;
a diaphragm pump configured to generate air and being in communication with the housing to provide air into a nozzle spraying chamber; and
a spray nozzle assembly configured to attach to the nozzle spraying chamber, the spray nozzle assembly having a liquid path centrally disposed there through, and an air passage way configured annularly around the liquid path such that the liquid and air meet at a tip of a spray nozzle assembly.

2. The airbrush system of claim 1, wherein said housing further comprises:
a nozzle spraying chamber;
a peristaltic pump configured to selectively draw liquid out of a pouch; and
a motor providing power to the peristaltic pump.

3. The airbrush system of claim 2, further comprising:
power means configured to selectively provide power to the motor and the diaphragm pump;
an on/off switch connected to the power means for providing power to the motor and diaphragm pump when the switch is maintained in a depressed state.

4. The airbrush system of claim 3, wherein said power means comprises a rechargeable battery.

5. The airbrush system of claim 3, wherein said power means comprises one or more replaceable batteries.

6. The airbrush system of claim 3, wherein said power means comprises an A/C plug configured to connection to an NC power source.

7. The airbrush system of claim 1, wherein the spray nozzle assembly further comprises:
a nozzle housing;
a spray nozzle having one end configured to be partially inserted into the nozzle housing; and
a nozzle housing cap having an outlet tip and being configured to receive the nozzle housing and spray nozzle and securing the spray nozzle assembly to the nozzle spraying chamber;
wherein the spray nozzle and nozzle housing cooperate to mix the liquid drawn from the reservoir pouch and through the spray nozzle with the air generated by the diaphragm pump at the tip of the nozzle housing cap.

8. The airbrush system of claim 1, wherein the liquid cartridge assembly is removable from the system.

9. An airbrush system comprising:
a liquid cartridge assembly comprising;
a liquid reservoir pouch; and
a flow check valve assembly for preventing liquid contained in the pouch from drying when not in use, wherein the flow check valve assembly further comprises:
a valve outer cover having one end in permanent connection with the liquid reservoir pouch and an upper end;
a ball bearing positioned in contact with the upper end of the valve outer cover;
a spring having one end in contact with the ball bearing and an opposing end; and
an inner surface housing retaining said ball bearing and spring in positioned against said valve outer cover;
said spring and said ball bearing cooperating to provide an air-tight seal to the reservoir pouch when not connected to the housing;
a housing comprising:
a nozzle spraying chamber;
a peristaltic pump configured to selectively draw liquid out of the pouch;
a motor providing power to the peristaltic pump;
a diaphragm pump configured to generate air and being in communication with the housing to provide air into the nozzle spraying chamber; and
a spray nozzle assembly configured to attach to the nozzle spraying chamber, the spray nozzle assembly having a liquid path centrally disposed there through, and an air passage way configured annularly around the liquid path such that the liquid and air meet at a tip of a spray nozzle assembly.

10. The airbrush system of claim 9, further comprising:
power means configured to selectively provide power to the motor and the diaphragm pump;
an on/off switch connected to the power means for providing power to the motor and diaphragm pump when the switch is maintained in a depressed state.

11. The airbrush system of claim 10, wherein said power means comprises a rechargeable battery.

12. The airbrush system of claim 10, wherein said power means comprises one or more replaceable batteries.

13. The airbrush system of claim 10, wherein said power means comprises an A/C plug configured to connection to an A/C power source.

14. The airbrush system of claim 9, wherein the spray nozzle assembly further comprises:
a nozzle housing;
a spray nozzle having one end configured to be partially inserted into the nozzle housing; and
a nozzle housing cap having an outlet tip and being configured to receive the nozzle housing and spray nozzle and securing the spray nozzle assembly to the nozzle spraying chamber;

wherein the spray nozzle and nozzle housing cooperate to mix the liquid drawn from the reservoir pouch and through the spray nozzle with the air generated by the diaphragm pump at the tip of the nozzle housing cap.

15. The airbrush system of claim 9, wherein the liquid cartridge assembly is removable from the system.

* * * * *